US007640880B2

(12) United States Patent
Gianfranco

(10) Patent No.: US 7,640,880 B2
(45) Date of Patent: Jan. 5, 2010

(54) AUTOMATIC SEWING DEVICE FOR HOSIERY KNITTING MACHINES

(75) Inventor: Colosio Gianfranco, Botticino (IT)

(73) Assignee: Cesare Colosio, SPA, Rezzatc (Brescua) (IT)

( * ) Notice: Subject to any disclaimer, the term of this patent is extended or adjusted under 35 U.S.C. 154(b) by 464 days.

(21) Appl. No.: 11/664,894

(22) PCT Filed: Oct. 21, 2005

(86) PCT No.: PCT/EP2005/011356

§ 371 (c)(1),
(2), (4) Date: Apr. 6, 2007

(87) PCT Pub. No.: WO2006/048138

PCT Pub. Date: May 11, 2006

(65) Prior Publication Data

US 2008/0190340 A1 Aug. 14, 2008

(30) Foreign Application Priority Data

Nov. 2, 2004 (IT) ..... MI2004A2084

(51) Int. Cl.
*D05B 35/00* (2006.01)
*D05B 33/00* (2006.01)
*D05B 21/00* (2006.01)
*D05B 27/00* (2006.01)

(52) U.S. Cl. ..... 112/470.08; 66/148; 112/470.15

(58) Field of Classification Search ..... 112/470.15, 112/470.08, 311, 475.12, 470.17, 470.18, 112/470.33; 66/17, 147–149 S
See application file for complete search history.

(56) References Cited

U.S. PATENT DOCUMENTS 4,020,775 A * 5/1977 King et al. ..... 112/470.15
4,570,556 A * 2/1986 Senba ..... 112/470.15
4,649,838 A * 3/1987 Gazzarrini ..... 112/470.15
5,207,165 A * 5/1993 Gazzarrini ..... 112/470.15
5,272,993 A * 12/1993 Gazzarrini ..... 112/470.15

(Continued)

FOREIGN PATENT DOCUMENTS

EP 942086 A 9/1999

(Continued)

*Primary Examiner*—Ismael Izaguirre
(74) *Attorney, Agent, or Firm*—R. Neil Sudol; Henry D. Coleman; William J. Sapone

(57) ABSTRACT

An automatic sewing device (1), particularly for hosiery knitting machines, characterized in that it comprises a supporting arm (2, 3, 4) for an oscillating means (7, 8), which comprises at least one first oscillating assembly (7), constituted by a semicircular ring, and at least one second oscillating assembly (8), constituted by a second semicircular ring, a means (11, 12) for actuating the oscillating assemblies which is suitable to produce at least one open position, in which the oscillating assemblies substantially form a ring which has the same size as the needle cylinder (24) from which it picks up a hosiery item at the end of the knitting process, and at least one closed position, in which the oscillating assemblies close the hosiery item in a semicircular arrangement, ready to be sewn, in a sewing station, the support being movable from at least one position for gripping the hosiery item from the needle cylinder to at least one position for applying the hosiery item to the sewing station.

10 Claims, 11 Drawing Sheets

U.S. PATENT DOCUMENTS

| | | | | |
|---|---|---|---|---|
| 5,761,931 | A * | 6/1998 | Lonati et al. | 66/148 |
| 6,826,930 | B2 * | 12/2004 | Frullini et al. | 66/148 |
| 7,107,797 | B2 * | 9/2006 | Frullini et al. | 66/148 |
| 2004/0216497 | A1 * | 11/2004 | Lonati et al. | 66/148 |
| 2005/0115279 | A1 * | 6/2005 | Magni | 66/148 |

FOREIGN PATENT DOCUMENTS

| | | |
|---|---|---|
| EP | 1375719 A | 1/2004 |
| EP | 1452635 A | 9/2004 |
| WO | 01/34890 | 5/2001 |

* cited by examiner

AUTOMATIC SEWING DEVICE FOR HOSIERY KNITTING MACHINES

BACKGROUND OF THE INVENTION

The present invention relates to an automatic sewing device particularly for hosiery knitting machines.

In circular hosiery knitting machines there is the problem of picking up the hosiery item at the end of knitting in order to take it to the sewing machine which performs its final sewing.

The aim of the present invention is to provide a device which is capable of picking up automatically a hosiery item at the end of the forming of its tubular part in order to take it to a sewing station.

OBJECTS OF THE INVENTION

An object of the invention is to provide a device which allows to grip the hosiery item at its tip in a manner which is simple, safe and reliable.

Another object of the invention is to provide a device which is capable of operating even with high-gauge hosiery, up to and beyond 200 needles.

Another object is to provide a device which allows to provide a flat and traditional stitched seam on the inside of the hosiery item.

This aim and these and other objects which will become better apparent hereinafter are achieved by an automatic sewing device, particularly for hosiery knitting machines, characterized in that it comprises a supporting arm for an oscillating means, which comprises at least one first oscillating assembly, constituted by a semicircular ring, and at least one second oscillating assembly, constituted by a second semicircular ring, a means for actuating the oscillating assemblies which is adapted to produce at least one open position, in which the oscillating assemblies substantially form a ring which has the same size as the needle cylinder from which it picks up a hosiery item at the end of the knitting process, and at least one closed position, in which the oscillating assemblies close the hosiery item in a semicircular arrangement, ready to be sewn, in a sewing station, the support being movable from at least one position for gripping the hosiery item from the needle cylinder to at least one position for applying the hosiery item to the sewing station.

Preferably, after the oscillating assemblies have closed the hosiery item in a semicircular configuration, the item is transferred to a hosiery supporting assembly, constituted by two half-rings which allow to change the grip from the selvage to the inside of the hosiery item in the row that directly precedes the rows where the sewing will be performed, in order to be subsequently moved toward the sewing station.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION OF PREFERRED EMBODIMENTS

Figure 1:
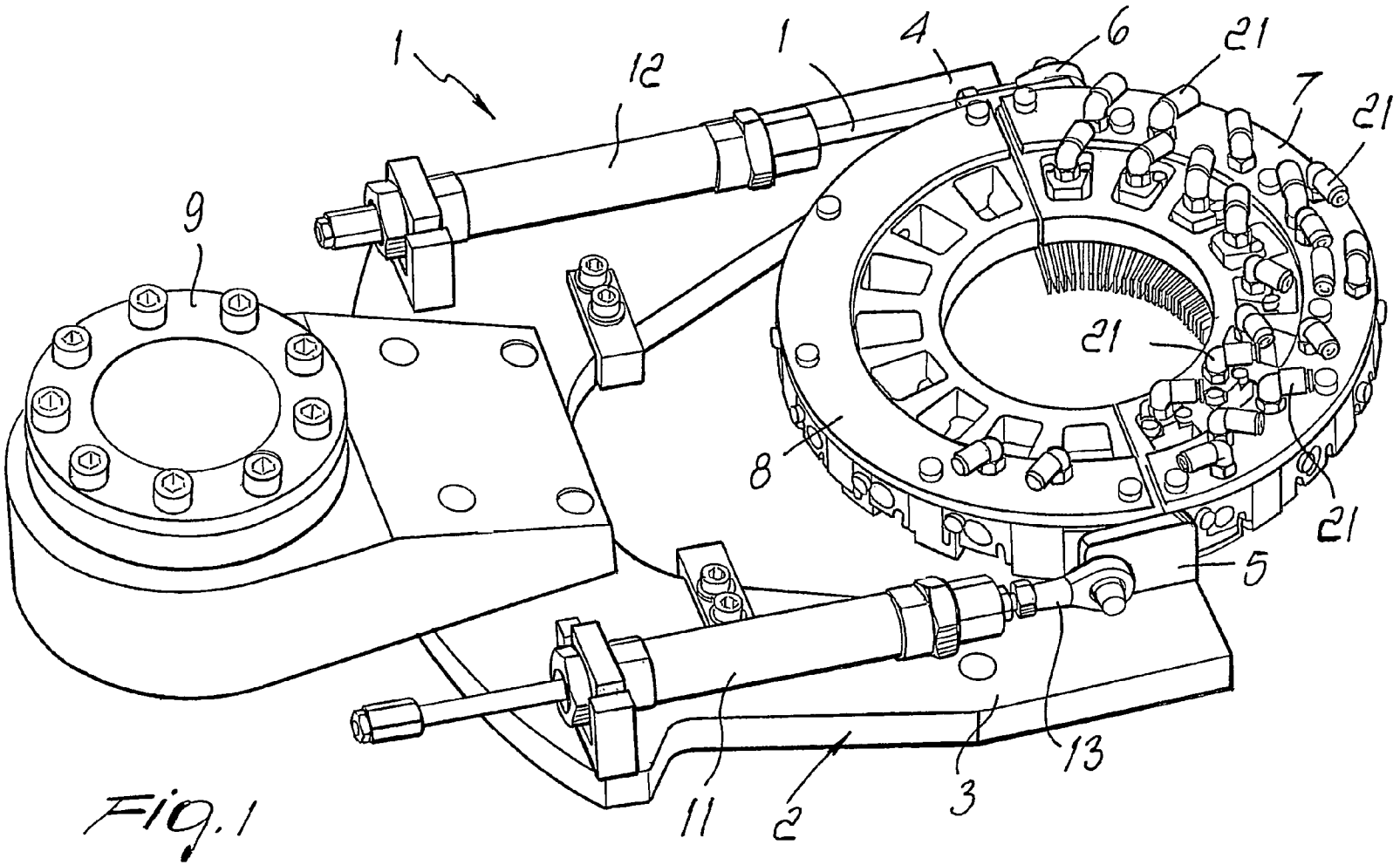
FIG. 1 is a side perspective view of the device according to the invention, shown in the open position.
Figure 2:
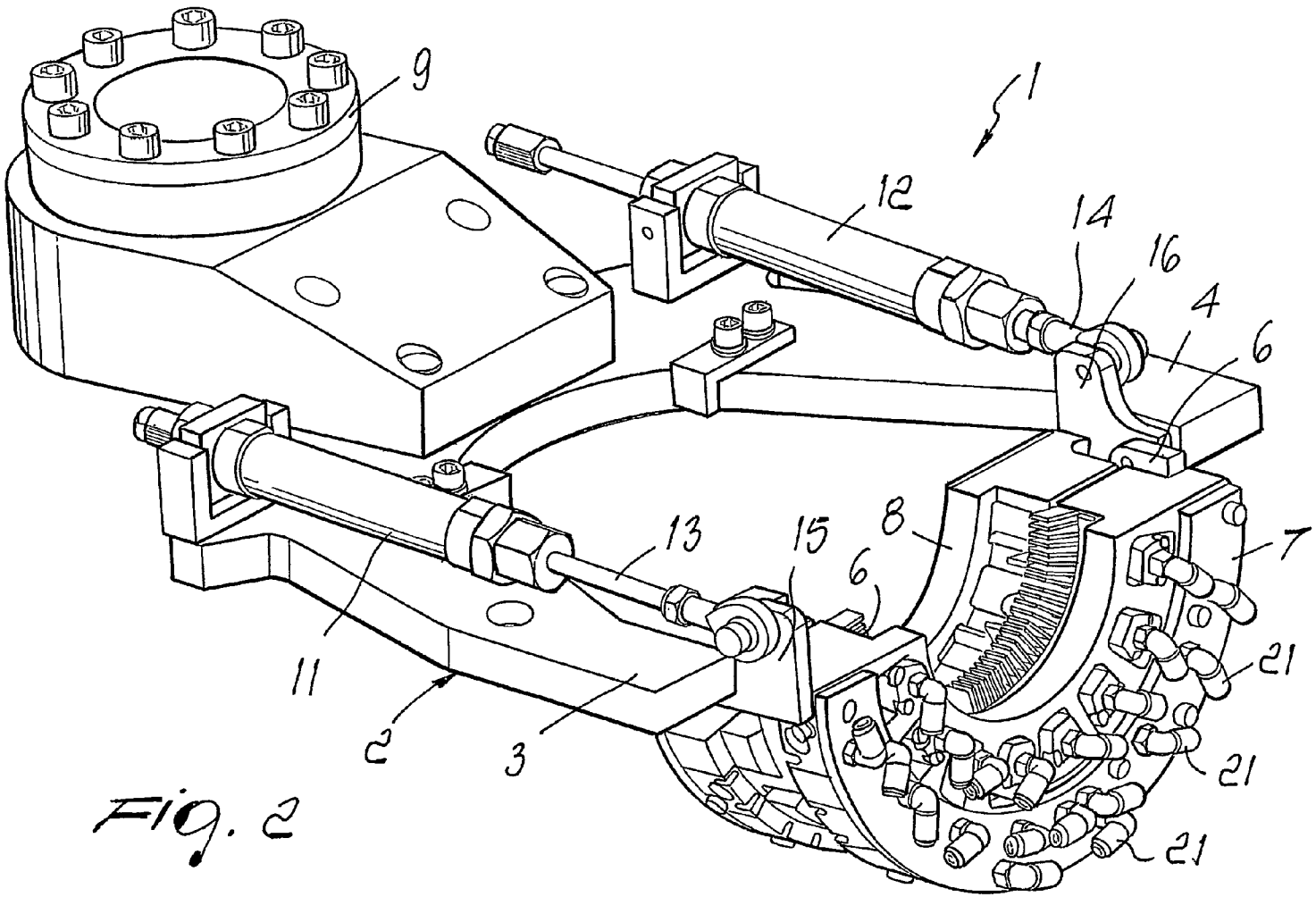
FIG. 2 is a front perspective view of the device according to the invention, shown in the closed position.

With reference to the cited figures, the device according to the invention, generally designated by the reference numeral 1, comprises a supporting arm, which is constituted by a fork 2, the prongs 3 and 4 of which end with respective hinges 5 and 6, to which a first oscillating assembly 7 is pivoted. The oscillating assembly is constituted by a semicircular ring connected, when the device is in the open position, to a second oscillating assembly 8, constituted by a semicircular ring which is rigidly coupled to the prongs 3 and 4 of the fork 2.

The fork 2 comprises a coupling 9 for a supporting member, not shown in the figures, with respect to which the device rotates and can move vertically from at least one position for gripping a selvage to at least one position for applying the selvage to a sewing station 50, preferably by means of an intermediate passage during which the hosiery item is clamped inside the selvage.

The two oscillating assemblies 7 and 8 are actuated by an actuation means, which is constituted by two pneumatic cylinders, designated by the reference numerals 11 and 12 respectively, which are rigidly coupled to the respective prongs 3 and 4 of the fork 2 and each have a stem 13 and 14 which is pivoted to a bar 15 and 16, each of which is rigidly coupled to one of the two oscillating assemblies, in the specific case the first oscillating assembly 7 and the second assembly 8.

Figure 3:
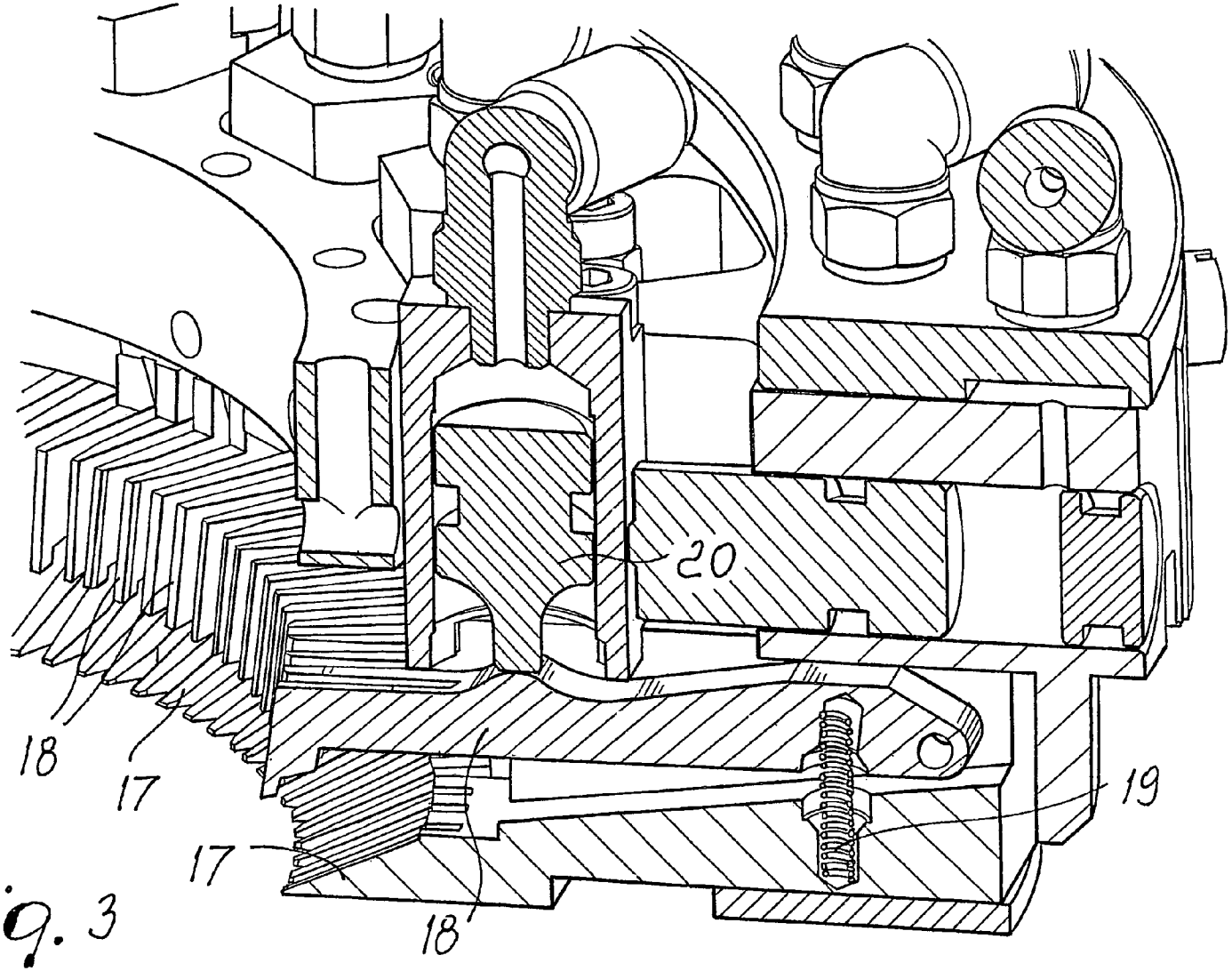
FIG. 3 is a partial sectional perspective view, illustrating in detail the laminar means, shown in the open position.
Figure 4:
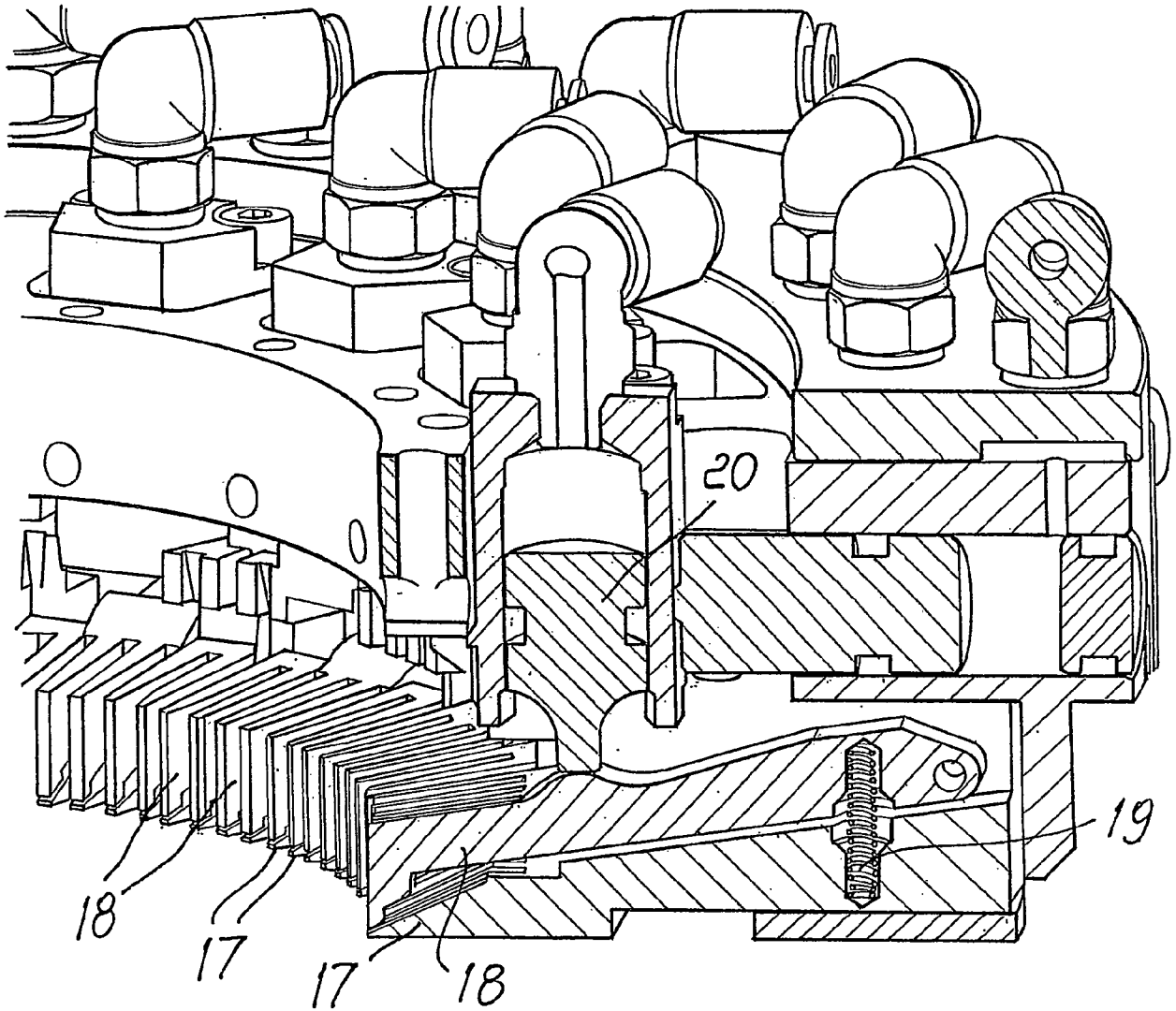
FIG. 4 is a partial sectional perspective view, illustrating in detail the laminar means, shown in the closed position.
Figure 5:
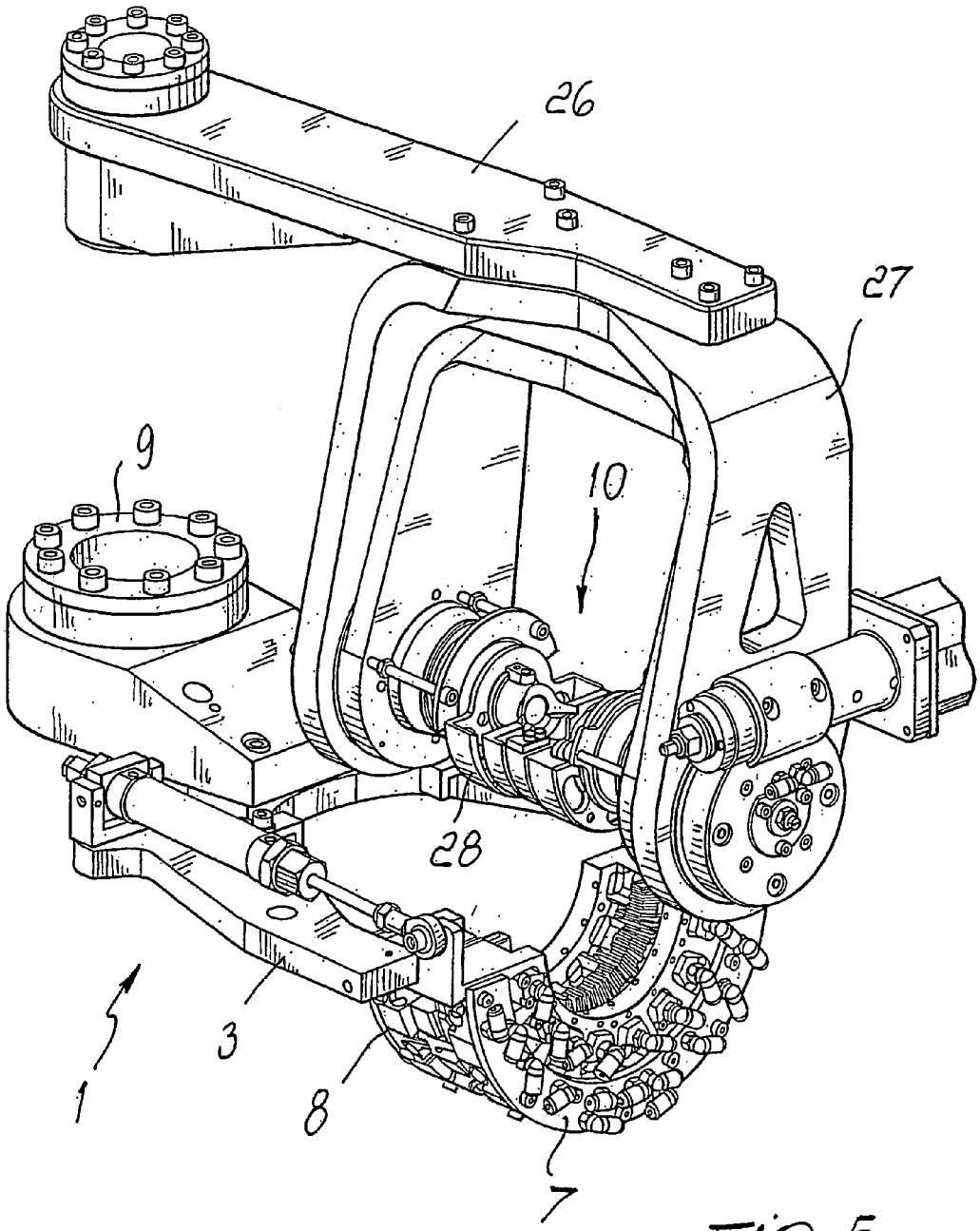
FIG. 5 is a partial perspective view of the device according to the invention, in the position adjacent to the sewing station.
Figure 6:
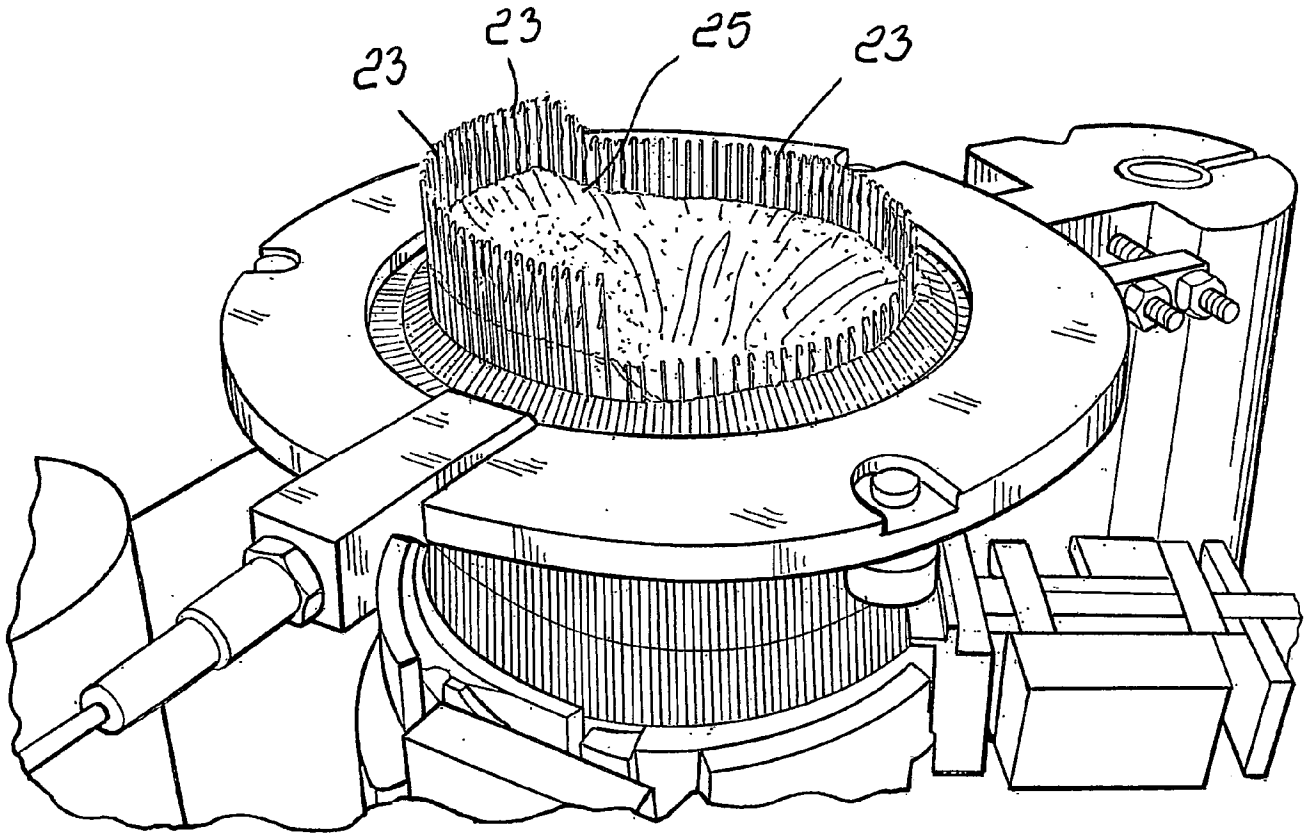
FIG. 6 is a perspective view of the upper part of the needle cylinder of the hosiery knitting machine to which the device according to the invention is applied.
Figure 7:
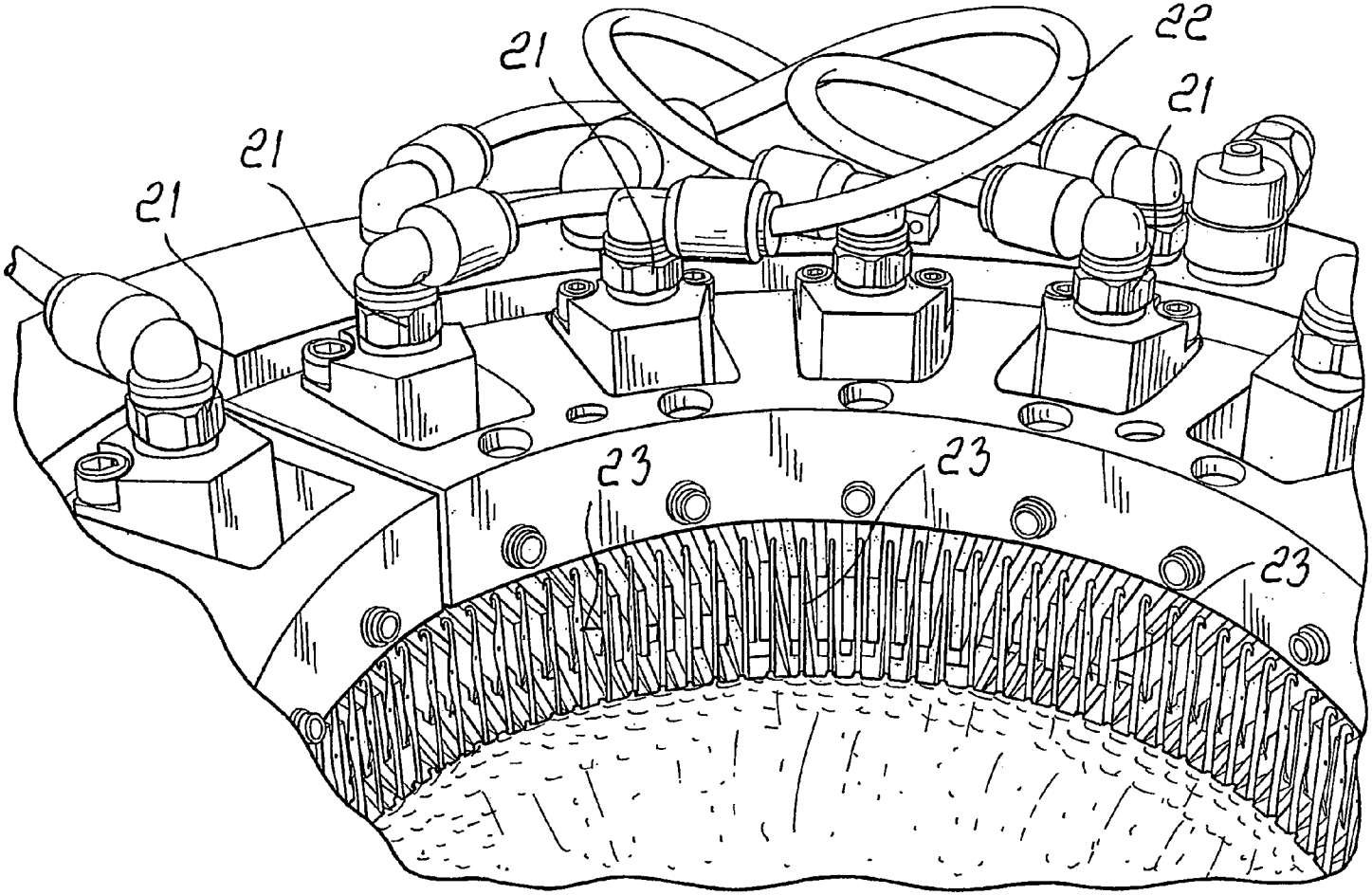
FIG. 7 is an enlarged-scale perspective view of the device, shown in the step for gripping the selvage.
Figure 8:
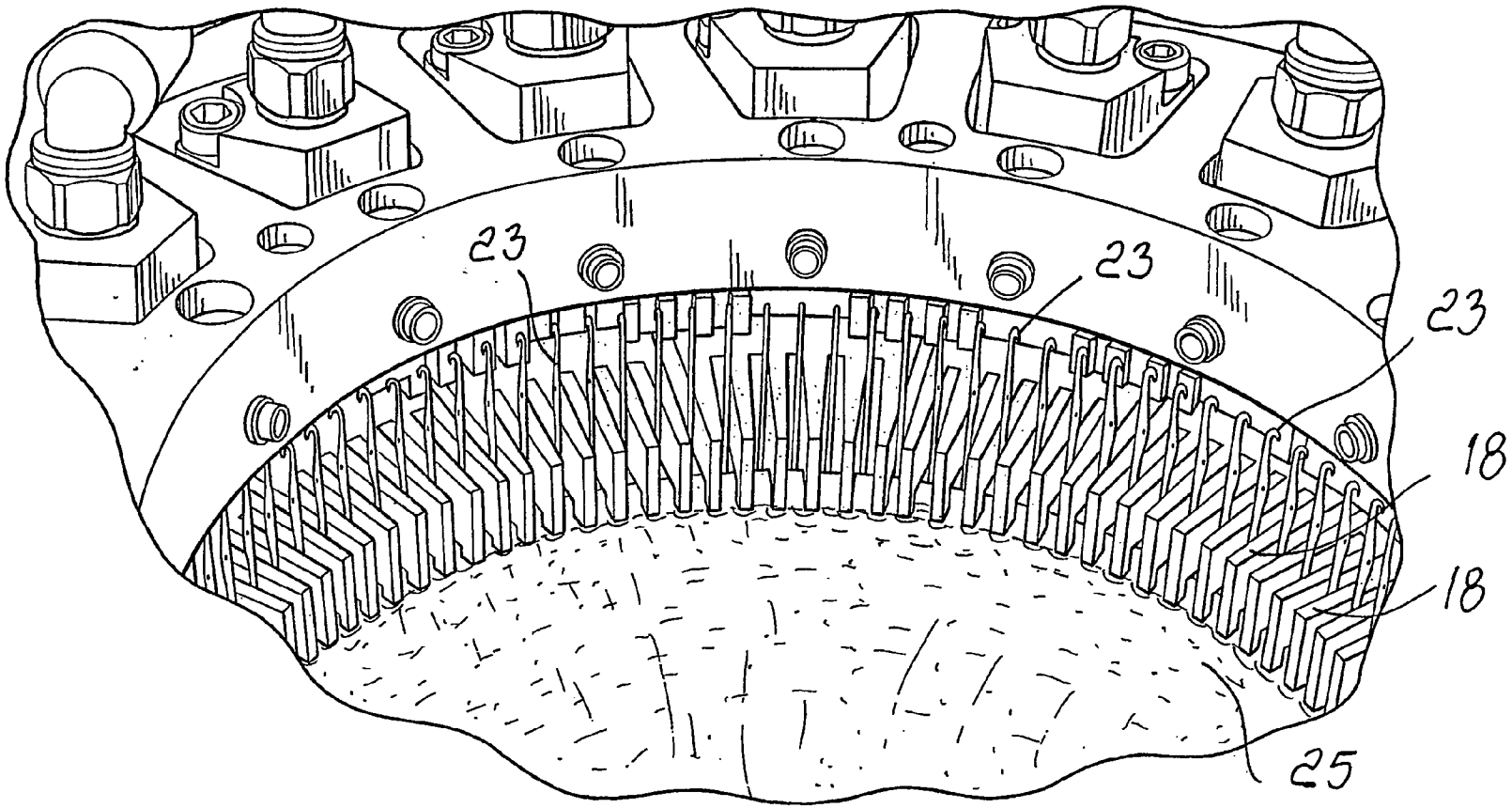
FIG. 8 is another perspective view of the device, shown in the step for gripping the selvage.

Both assemblies 7 and 8 comprise a blade means, which is constituted by a set of fixed blades 17 and a set of moving blades 18, which have at least one open position, shown in FIG. 3, and at least one closed position, shown in FIG. 4.

The open position of the moving blades 18 is determined by the presence of an elastic means, which is constituted by springs 19 which act in contrast with a pneumatic actuator 20, which closes the blades when it is active or opens them, by the thrust of the springs 19, when it is not active.

The pneumatic actuators 20 of the blades are supplied by connectors 21, which are external to the first oscillating assembly and are connected to supply hoses 22.

The blades 17 and 18 are arranged so as to accommodate between them the needles 23 of a cylinder of a hosiery knitting machine, generally designated by the reference numeral 24. The hosiery knitting machine can be of the per se known type and is not described here for the sake of brevity.

As is known, at the end of the knitting of the hosiery item, the selvage, designated by the reference numeral 25, is located at the upper end of the needle cylinder and must be picked up in order to be taken to the sewing station.

The needles of the cylinder, selected one by one, are lifted, raising the last row of knitting of the selvage above the sinkers.

According to the invention, at this point the device 1 intervenes and places itself above the needle cylinder, with the oscillating assemblies 7 and 8 in the open position and forming a ring which has the same size as the needle cylinder.

The ring constituted by the oscillating assemblies 7 and 8 then moves downward, with the blades at the height of the last row of knitting of the selvage.

At this point, the blades 17 and 18 move radially toward the inside of the axis of the cylinder, because they are divided into sectors with multiple teeth each, and the fixed and moving blades slide simultaneously so as to have at least one position on the outside of the diameter where there are needles and at least one position inside the diameter where there are needles.

Figure 9:
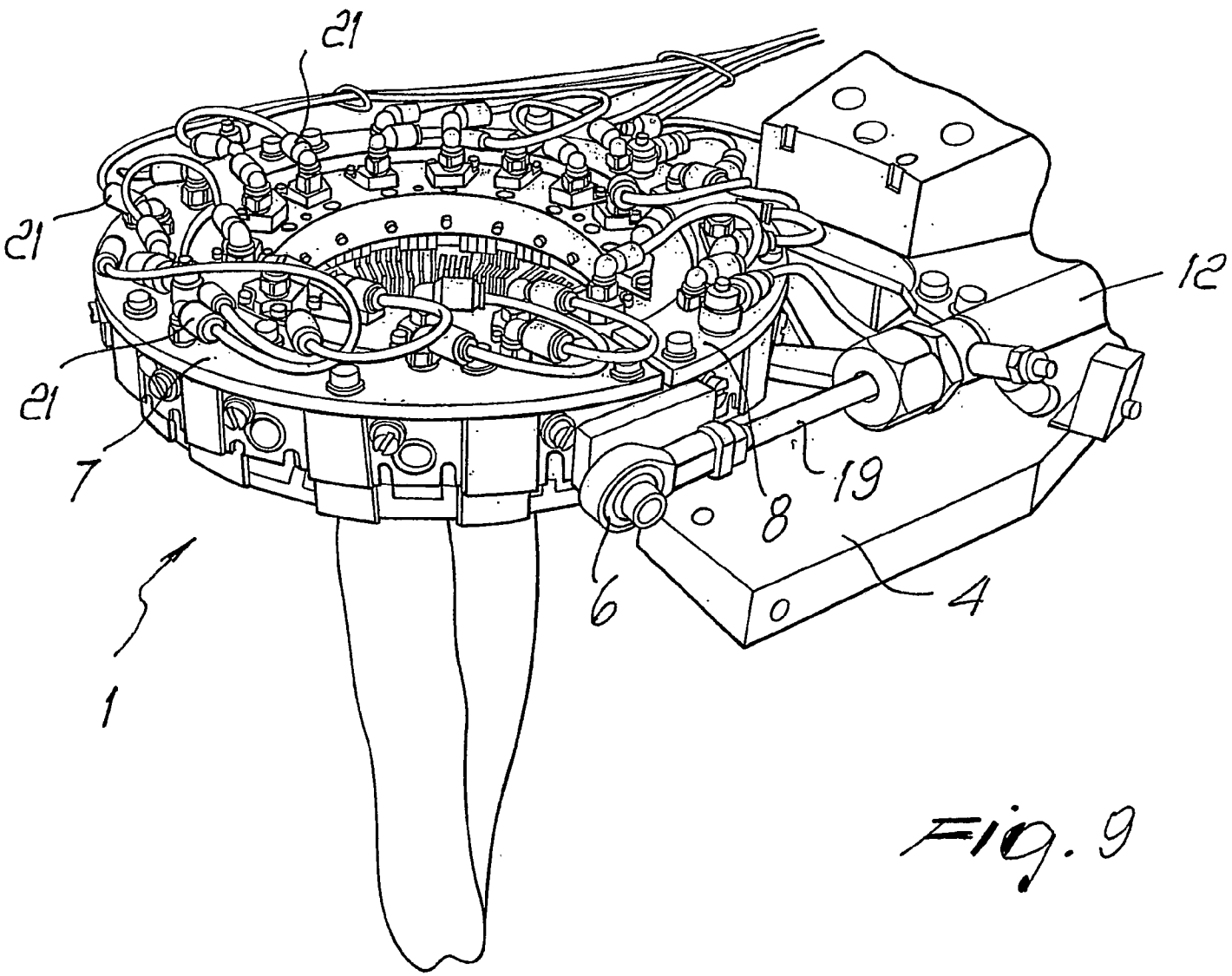
FIG. 9 is a perspective view of the device in a step for conveying the hosiery item.
Figure 10:
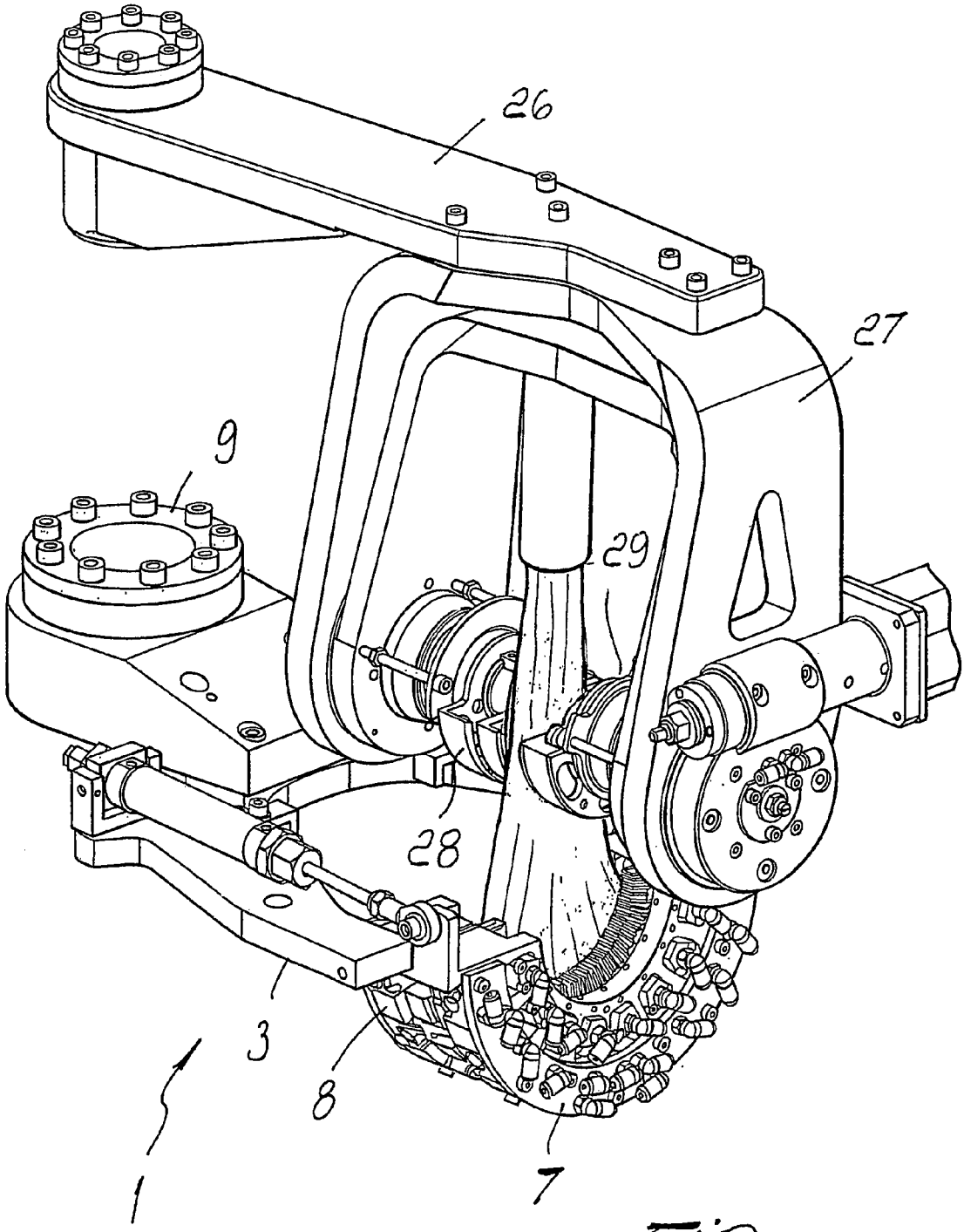
FIG. 10 is a partial perspective view of the device during the step for applying the hosiery item to the sewing station.
Figure 11:
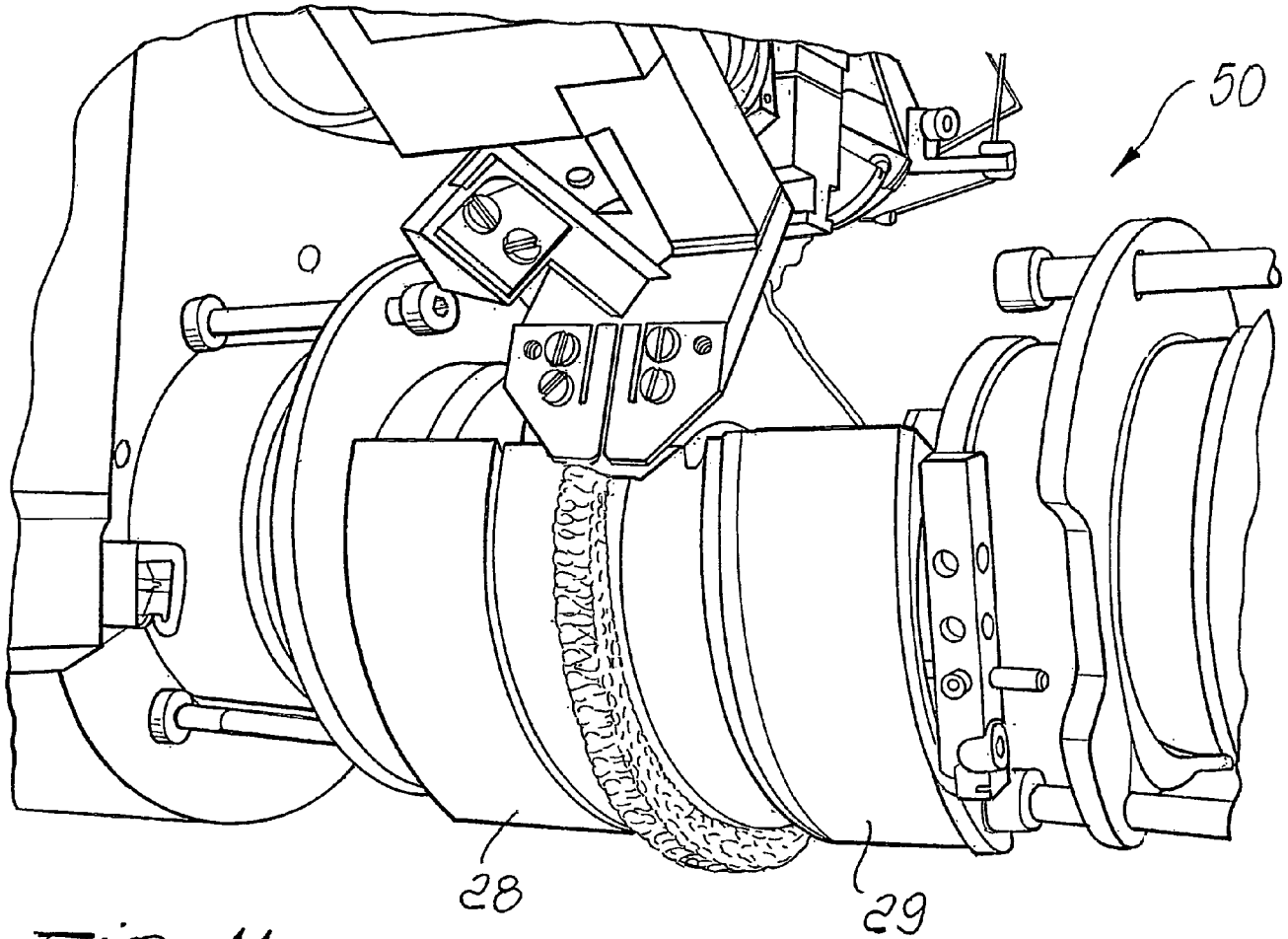
FIG. 11 is a perspective view, enlarged with respect to FIG. 10, which illustrates in greater detail the hosiery supporting assembly during the sewing step.

Once the selvage has been taken from the needle cylinder, as shown in FIG. 9, the device is moved away from the needle cylinder and, before reaching the sewing station 50, the pneumatic cylinders 12 and 13 are actuated, closing the oscillating assemblies 7 and 8, which accordingly have the selvage closed in a semicircle, ready to be transferred to a hosiery supporting assembly, generally designated by the reference numeral 10.

The hosiery supporting assembly 10 is constituted by a rotating arm 26, which supports an inverted fork 27, to which a shaft is applied which in turn supports two semicircular rings 28 and 29.

The semicircular rings 28 and 29 support the selvage in the transfer from the oscillating assemblies 7 and 8 to the sewing station 10.

In practice it has been found that the invention achieves the intended aim and objects, a device having been provided which is capable of picking up a hosiery item at the end of its knitting in the needle cylinder and of supplying the selvage to the sewing station in a fully automatic manner.

An advantage of the invention also resides in that the device also allows to pick up men's socks with a high gauge, up to and above 200 needles, assuredly and reliably.

The device also allows to perform flat and traditional sewing on the inside of the hosiery item.

The device according to the invention is susceptible of numerous modifications and variations, within the scope of the appended claims. All the details may be replaced with technically equivalent elements.

The materials used, as well as the dimensions, may of course be any according to the requirements and the state of the art.

What is claimed is:

1. An automatic sewing device, particularly for hosiery knitting machines, comprising a supporting arm for an oscillating means, which includes at least one first oscillating assembly, constituted by a semicircular ring, and at least one second oscillating assembly, constituted by a second semicircular ring, a means for actuating said oscillating assemblies which is adapted to produce at least one open position, in which the oscillating assemblies substantially form a ring that has the same size as a needle cylinder from which it picks up a hosiery item at the end of the knitting process, and at least one closed position, in which the oscillating assemblies close the hosiery item in a semicircular arrangement, ready to be sewn, in a sewing station, said supporting arm being movable from at least one position for gripping said hosiery item from said needle cylinder to at least one position for applying said hosiery item to said sewing station by virtue of a hosiery supporting assembly.

2. The device according to claim 1, wherein said hosiery supporting assembly comprises two half-rings, which allow changing the grip from the selvage to the inside of the hosiery item in the row that directly precedes the rows where sewing will be performed, in order to be subsequently moved toward the sewing station.

3. The device according to claim 2, wherein said hosiery supporting assembly further comprises a rotating arm, which supports an inverted fork to which a rotating shaft is applied, said shaft in turn supporting said half-rings.

4. The device according to claim 1, wherein said supporting arm further comprises a fork, the prongs of which end with respective hinges to which said first oscillating assembly is pivoted, said assembly being constituted by a semicircular ring that is connected, when the device is in the open position, to said second oscillating assembly constituted by a semicircular ring that is rigidly coupled to the prongs of the fork.

5. The device according to claim 3, wherein said fork comprises a coupling for a supporting member, with respect to which the device rotates and can move vertically from at least said grip position to said position for application to the sewing station.

6. The device according to claim 4, wherein said oscillating assemblies are actuated by an actuation means, which includes two pneumatic cylinders that are rigidly coupled to the respective prongs of the fork, each cylinder having a stem which is pivoted to a bar that is rigidly coupled to at least one of the two oscillating assemblies.

7. The device according to claim 4, wherein the oscillating assemblies comprise a blade means, which includes a set of fixed blades and a set of moving blades, which have at least one open position and at least one closed position.

8. The device according to claim 7, wherein said open position of the movable blades is determined by an elastic means, which includes springs that act in contrast with a pneumatic actuator that closes the blades when it is active or opens them, by the thrust of the springs, when it is not active.

9. The device according to claim 8, wherein said pneumatic actuators of the blades are supplied by connectors which are external to said oscillating assembly and are connected to supply hoses.

10. The device according to claim 7, wherein said blades are arranged so as to accommodate between them the needles of the cylinder of the hosiery knitting machine.

* * * * *